US006494552B1

(12) United States Patent
Miyamoto et al.

(10) Patent No.: US 6,494,552 B1
(45) Date of Patent: Dec. 17, 2002

(54) IMAGE FORMING METHOD AND APPARATUS

(75) Inventors: Akio Miyamoto, Shizuoka (JP); Kouya Kawabata, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 13 days.

(21) Appl. No.: 09/684,329

(22) Filed: Oct. 10, 2000

(30) Foreign Application Priority Data

Oct. 8, 1999 (JP) ..... 11-288179
Nov. 4, 1999 (JP) ..... 11-313979

(51) Int. Cl.[7] ..... B41J 2/005; B41J 2/01; B41J 2/315; B41J 2/32

(52) U.S. Cl. ..... 347/1; 347/171

(58) Field of Search ..... 347/171, 1

(56) References Cited

U.S. PATENT DOCUMENTS 5,200,762 A * 4/1993 Katano et al. ..... 347/171
6,108,021 A * 8/2000 Morikawa et al. ..... 347/171

FOREIGN PATENT DOCUMENTS

JP 07-256905 * 10/1995
JP 11-198421 * 7/1999

* cited by examiner

*Primary Examiner*—Huan Tran
(74) *Attorney, Agent, or Firm*—Sughrue Mion, PLLC

(57) ABSTRACT

In order to transfer a transfer recording layer 7 in a transfer medium 9 onto the surface of a receptor 15, a solution that lowers the transfer temperature or a sticky solution is applied image-wise to the surface of either the transfer recording layer 7 or the receptor 15 so as to form a latent image; then, whichever of the transfer medium 9 or the receptor 15 that have the latent image formed thereon or both are heated by a thermal drying means 11 to evaporate at least a portion of the solvent contained in the formed latent image; subsequently, the transfer medium 9 and the receptor 15 are heated, with the surface of the transfer recording layer 7 in intimate contact with that of the receptor 15, so that the transfer recording layer 7 in areas corresponding to the ones where the latent image has been formed is transferred onto the receptor 15.

9 Claims, 2 Drawing Sheets

IMAGE FORMING METHOD AND APPARATUS

BACKGROUND OF THE INVENTION

1. Field of the Invention

This invention relates to an image forming method operating on thermal transfer technology and an apparatus for forming images by the method.

2. Description of the Related Art

Thermal transfer technology is one of the conventional methods of forming images on transfer media such as paper and films. In this technology, a transfer medium (toner sheet) comprising a base having on its surface a transfer layer of pigment-base toner particles which are a transfer material and a receptor (image-receiving sheet) such as paper or a film are placed one on the other and heat is applied image-wiseimage-wise to the back of the toner sheet's base by means of a thermal head, a laser head or the like so that the toner particles are thermally transferred onto the image-receiving sheet to form an image on it. One way to implement the thermal transfer technology is dye-sublimation in which colored dyes are converted from a solid state to vapors and then transferred onto an image-receiving sheet, where the vapors cool back to solid colors.

Images can also be formed on an image-receiving sheet by ink-jet technology where ink is forced out in drops. The essential components of an ink-jet printer are a plurality of inkhead's nozzles, mutually independent firing chambers that communicate with the orifices of the nozzles and which have flexing walls, piezoelectric devices mounted on the flexing walls, and a common ink cavity from which ink is supplied into the firing chambers.

When a pulsed voltage associated with image information is applied to the piezoelectric devices, the walls of each firing chamber flex mechanically to reduce its volume, whereupon the internal pressure is increased rapidly enough that ink drops are successively propelled through the nozzle to form an image on the image-receiving sheet.

The use of a thermal head in the thermal transfer technology involves the problem that due to various factors including the variations in the resistances of heat generating elements on the head, nonuniform contact between the head and the transfer medium and unevenness in the thickness of the base of the thermal transfer medium, there is a high likelihood for uneven temperature profile and unevenness occurs in the image being formed. As a further problem, localized heating at high temperature increases the chance of the base deforming to produce wrinkles.

The use of laser light involves not only substantial investment cost but also a high likelihood for the occurrence of image unevenness due principally to the decomposition of materials upon momentary heating at elevated temperature.

The ink-jet technology is free from the problem of base deformation due to the heat being applied during recording but it is mandatory to prevent the clogging of nozzles by ink so that uniform ink drops will form consistently. This poses many limitations on the choice of image forming materials in terms of liquid's physical properties and color imagery is not an exception. In order to prevent the clogging of nozzles, ink materials have to be chosen from a limited list of dyes and pigments and colors identical to those of printing ink pigments cannot be reproduced; this has made the ink-jet technology unsuitable for use on high-precision proofing printers. As further problems, ink-jet formed images do not have high lightfastness and waterfastness and the dyes tend to bleed on the receptor, eventually causing failure to produce high-resolution images.

With a view to solving these problems, the present inventors previously proposed a technique in which a liquid substance capable of lowering the transfer temperature was propelled imagewiseimage-wise onto a transfer material for use in the conventional heat transfer technology and hot transfer was subsequently performed to produce a uniform image of high color reproduction fidelity while ensuring against the clogging of nozzles. This proposal was described in Japanese Patent Application No. 170702/1999.

This approach can produce transferred images of high quality. However, it is apprehended that when transfer is repeated plural times to obtain a multi-color image, a color can be easily transferred onto the image which has been just transferred, causing the occurrence of so-called secondary color (multi-order color) sensitization, i.e., staining of the transferred color image.

In order to use this approach for the preparation of print proof for proving the printing conditions, it is necessary to transfer an image onto a dedicated image-receiving sheet from which it is then transferred onto a printing sheet. It has thus been desired to realize a process for transferring an image directly from the transfer layer onto the printing sheet for the purpose of simplifying the process and improving the image quality of print proof. The term "printing sheet" as used herein is meant to indicate paper, film, metal foil or other materials on which printing is effected.

This approach could produce transferred images of high quality. However, it was suspected that when the liquid substance was passed between hot pressure rolls after being forced out of the nozzles, the transferred dots might spread depending upon the temperature and pressure conditions, thus lowering the resolution of the image being formed. In order to prevent the decrease of resolution, precise temperature and pressure adjustments have to be made but this complicates rather than simplifies the adjustment procedure.

SUMMARY OF THE INVENTION

The present invention has been accomplished under these circumstances and has as an object solving the problems of limited image forming materials and clogged nozzles which are posed by the ink-jet technology while eliminating the two drawbacks of the thermal transfer technology, a damaged base and an uneven image, as well as attaining the following advantages:

1) A transferred image can be directly formed on the printing sheet;
2) A transferred image can be formed free from secondary color (multi-order color) sensitization;
3) image forming materials difficult to use in the conventional ink-jet technology can be employed to record images;
4) uneven images can be formed at low cost without using an expensive laser head;
5) images can be formed without damaging or wrinkling the base;
6) highly lightfast and waterfast images can be formed without bleeds; and
7) high-resolution images can be formed.

The stated object of the invention can be attained by the image forming method as one of the embodiments of this invention which uses a transfer medium having a transfer recording layer on a base and a receptor onto which said transfer recording layer is to be transferred, characterized by comprising:

a latent image forming step in which in order to transfer said transfer recording layer onto the surface of said receptor, a solution that lowers the transfer temperature of said transfer recording layer or a sticky solution is applied image-wiseimage-wise to the surface of either said transfer recording layer or said receptor so as to form a latent image;

a thermal drying step in which at least a portion of the solvent contained in the formed latent image is evaporated by heating; and a transfer step in which said transfer medium and said receptor are heated, with the surface of the transfer recording layer in intimate contact with that of the receptor, so that said transfer recording layer in areas corresponding to the ones where said latent image has been formed is transferred onto the receptor.

In the latent image forming step of the image forming method, a solution that lowers the transfer temperature of the transfer recording layer or a sticky solution is applied imagewiseimage-wise to the surface of either the transfer recording layer or the receptor so as to form a latent image; in the subsequent thermal drying, at least a portion of the solvent contained in the formed latent image is evaporated by heating; and in the following transfer step, the transfer medium and the receptor are heated, with the surface of the transfer recording layer in intimate contact with that of the receptor, so that the transfer recording layer in areas corresponding to the ones where the latent image has been formed is transferred onto the receptor. As a result, when the transfer medium is brought into intimate contact with the receptor, the already formed latent image will not be transferred as larger dots and, instead, the transfer recording layer will be directly formed on the receptor at high resolution. This eventually improves image resolution, simplifies the image forming process and enables the formation of even images at low cost.

The image forming method also solves the problem of uneven temperature profile which often occurs in the conventional thermal transfer technology due to various factors such as unevenness in the thickness of the base, uneven contact with the thermal head and uneven heat diffusion. The method is also free from the problems of limited choice of image forming materials and the clogging of nozzles that are frequent in the conventional ink-jet technology.

The stated object of the invention can also be attained by the image forming apparatus as another embodiments of this invention which performs image-wiseimage-wise transfer onto a receptor of a transfer recording layer in a transfer medium which is provided on a base and which is made of a thermal transfer material, characterized by comprising:

a drop firing head with which in order to transfer said transfer recording layer onto the surface of said receptor, a solution that lowers the transfer temperature of said transfer recording layer or a sticky solution is applied image-wise to the surface of either said transfer recording layer or said receptor so as to form a latent image;

a thermal drying means which heats either said transfer medium or said receptor or both on which said latent image has been formed so as to evaporate at least a portion of the solvent contained in the formed latent image; and a pair of pressure rollers which hold said transfer medium and said receptor together, with the surface of the transfer recording layer in intimate contact with that of the receptor, at least one of said pressure rollers having a heating means capable of controlling the heating temperature.

By means of the drop firing head in the image forming apparatus, a solution that lowers the transfer temperature of the transfer recording layer or a sticky solution is applied image-wise to the surface of either the transfer recording layer or the receptor so as to form a latent image; by the thermal drying means, at least a portion of the solvent contained in the formed latent image is evaporated by heating; and by means of the pair of pressure rollers having a heating means, the transfer medium and the receptor are heated, with the surface of the transfer recording layer in intimate contact with that of the receptor, so that only the transfer recording layer in areas corresponding to the ones where the latent image has been formed is transferred onto the receptor. As a result, when the transfer medium is brought into intimate contact with the receptor, the already formed latent image will not be transferred as larger dots and, instead, the transfer recording layer will be directly formed on the receptor at high resolution. This eventually improves image resolution, simplifies the image forming process requiring only a straightforward structural design and enables the formation of even images at low cost.

Said image forming apparatus may be also modified such that said thermal drying means has a heating temperature control unit for setting the heating temperature in accordance with the result of transfer of the transfer recording layer.

Since the thermal drying means controls the setting of heating temperature in accordance with the result of transfer of the transfer recording layer, image can be formed at an optimum transfer temperature to maintain high image quality throughout the service of the apparatus.

DESCRIPTION OF THE PREFERRED EMBODIMENTS

Figure 1:
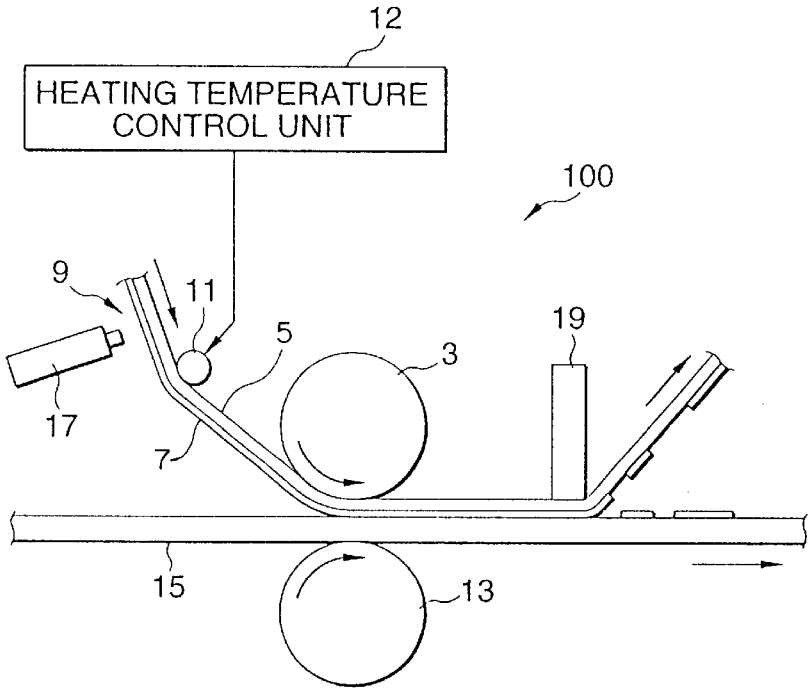
FIG. 1 is a schematic representation of the image forming apparatus of the invention according to its first to third embodiments.

We now describe in detail how the image forming method and apparatus of the invention are implemented.

The image forming method of the invention is characterized in that a transfer medium comprising a base overlaid with a transfer recording layer made of a thermal transfer material is superposed on a receptor for transfer of the transfer recording layer after a latent image has been formed by application of a solution that lowers the transfer temperature of the transfer recording layer or a sticky solution. The method generally comprises the following steps.

First, in order to transfer the transfer recording layer onto the surface of the receptor, a solution that lowers the transfer temperature of the transfer recording layer (specifically, a solution containing a material that lowers the transfer temperature) or a sticky solution (specifically, a solution containing a sticky material) is applied image-wise to the surface of either the transfer recording layer or the receptor so as to form a latent image (the step of forming a latent image).

Then, at least a portion of the solvent contained in the formed latent image is evaporated by heating (the step of thermal drying). The heating temperature is controlled in accordance with the result of transfer of the transfer recording layer so as to keep a temperature capable of optimal transfer.

Subsequently, the transfer medium and the receptor are heated, with the surface of the transfer recording layer in intimate contact with that of the receptor, so that the transfer recording layer in areas corresponding to the ones where the latent image has been formed is transferred onto the receptor (the transfer step). Note that the heating temperature for the transfer step is set lower than the temperature at which the areas where the latent image has not been formed (i.e., the areas where the solution that lowers the transfer temperature of the transfer recording layer or the sticky solution has not been deposited) are transferred but not lower than the temperature at which the areas where the latent image has been formed is transferred.

The present invention is characterized in that image formation is carried out by making the use of the mechanism that transfer can be effected at a lower temperature on areas of the surface of the transferring layer of the transfer medium or the surface of the image-receiving material provided with a solution containing a sticky material than on the other areas.

After the end of these steps of latent image formation and transfer, the transfer medium is stripped from the receptor, whereupon the transfer recording layer is transferred image-wise onto the surface of the receptor at high enough resolution to produce the desired image.

The main thrust of the invention is that prior to the transfer step in which the transfer medium is brought into intimate contact with the receptor, at least a portion of the solvent contained in the latent image formed in the step of latent image formation is evaporated so that the spread of transferred dots is effectively prevented to form the desired image while avoiding the decrease in resolution.

Specific examples of the material that lowers the transfer temperature include water, organic solvents and surfactants.

Exemplary organic solvents include: $C_{1-4}$ alkyl alcohols such as methyl alcohol, ethyl alcohol, n-propyl alcohol, i-propyl alcohol, n-butyl alcohol, sec-butyl alcohol and tert-butyl alcohol; amides such as dimethylformamide and dimethylacetamide; monohyric or polyhydric alcohols such as ethylene glycol, 1,2,6-hexanetriol, thiodiglycol, propylene glycol, diethylene glycol, triethylene glycol, polyethylene glycol, polypropylene glycol and glycerin; ethers such as dioxane, ethylene glycol monomethyl ether, ethylene glycol monobutyl ether, propylene glycol monobutyl ether, triethylene glycol monobutyl ether and tripropylene glycol monomethyl ether; ketones or ketoalcohols such as acetone, methyl ethyl ketone, methyl isobutyl ketone and diacetone alcohol; and N-methyl-2-pyrrolidone, 2-pyrrolidone and 1,3-dimethyl-2-imidazolidinone.

The surfactant may be anionic, cationic, nonionic or amphoteric and specific examples include aliphatic acid salts, alkyl sulfate ester salts, polyoxyethylene alkyl ether sulfate ester salts, alkylbenzene sulfonate salts, alkylnaphthalene sulfonate salts, alkylsulfosuccinate salts, alkyldiphenyl ether disulfonate salts, alkyl phosphate salts, Na salts of naphthalene sulfonate formaldehyde condensation products, polyoxyethylene alkyl ethers, polyoxyethylene alkylene-alkyl ethers, polyoxyethylene aliphatic acid esters, polyoxyethylene alkylamines, alkylalkanolamines, alkylamine salts and alkylbetaines.

The sticky material as used herein means substances that are sticky at ordinary temperatures or upon heating and is mainly exemplified by organic polymers. Specific examples include: homopolymers and copolymers of acrylic monomers such as acrylic acid, methacrylic acid, acrylate esters and methacrylate esters; homopolymers of vinyl monomers such as poly(vinyl acetate), polystyrene, poly(vinyl pyrrolidone), poly(vinyl butyral), poly(vinyl alcohol) and poly(vinyl chloride) and copolymers thereof such as ethylene-vinyl acetate copolymer; condensation polymers such as polyesters and polyamides; and rubber-base polymers such as styrene-butadiene copolymer and acrylonitrile-butadiene copolymer. Among these polymers, those having a glass transition point (Tg) lower than 90° C. are preferred. The polymers as sticky materials may be dispersed in water to form an emulsion, or a latex.

The solution that lowers the transfer temperature means such a solution that the material that lowers the transfer temperature is dissolved or dispersed in water or an organic solvent, and the sticky solution means such a solution that the sticky material is dissolved or dispersed in water or an organic solvent. Specific examples of the organic solvent include: alkyl alcohols such as methyl alcohol, ethyl alcohol, n-propyl alcohol and i-propyl alcohol; amides such as dimethylformamide and dimethylacetamide; monohyric or polyhydric alcohols such as ethylene glycol, 1,2,6-hexanetriol, thiodiglycol, propylene glycol, diethylene glycol, triethylene glycol, polyethylene glycol, polypropylene glycol and glycerin; ethers such as dioxane, ethylene glycol monomethyl ether, ethylene glycol monobutyl ether, propylene glycol monobutyl ether, triethylene glycol monobutyl ether and tripropylene glycol monomethyl ether; ketones or ketoalcohols such as acetone, methyl ethyl ketone and diacetone alcohol.

In order to dissolve or disperse the material that lowers the transfer temperature or the sticky material, water or the organic solvents mentioned above may be used either independently or in admixture. In order to improve the firing efficiency, the keeping quality of liquids and the adhesion characteristics, a surface tension control agent, a mold inhibitor, a viscosity modifier, a pH modifier, an antifoaming agent, a plasticizer and any other suitable additives may be incorporated in the solutions mentioned above.

We now describe the respective elements of the transfer medium to be used in the image forming method of the invention.

The transfer medium comprises a base overlaid with a transfer recording layer made of a thermal transfer material. On the pages that follow, the base, the transfer recording layer and any other layers that may be provided as needed are described in detail.

Base

The constituent material of the base is not limited in any particular way and various base materials can be used depending on the object. Preferred examples for base materials are synthetic resin materials such as polyethylene terephthalate, polyethylene-2,6-naphthalate, polycarbonate, polyethylene, polyvinyl chloride, polyvinylidene chloride, polystyrene and styrene-acrylonitrile copolymer. Among these resins, biaxially oriented polyethylene terephthalate is preferred since it has high mechanical strength and good dimensional stability against heat.

In order to improve adhesion to the transfer recording layer provided on it, the base is preferably subjected to surface roughening or provided with one or more layers of undercoat. Surface roughening can be effected by, for example, glow discharge treatment or corona discharge treatment. The undercoat layer is preferably made of a material that shows good adhesion to the surfaces of both the base and the transfer recording layer and which also exhibits high heat resistance. Examples of the preferred undercoating material include polystyrene, styrenebutadiene copolymer and gelatin. The overall thickness of the undercoat layer typically ranges from 0.01 to 2 μm. The surface of the side of a thermal transfer sheet which is opposite the side where the transfer recording layer is provided may optionally be provided or treated with a release layer or any other functional layers.

Transfer Recording Layer

In the case of forming chromatic images, the transfer recording layer contains at least pigments that are transferred onto the image-receiving sheet to form a colored image; a binder resin to form the layer is also contained and other components may be incorporated as needed. The transfer recording layer to be used in the invention is in no way limited to chromatic recording layers and if it is to be used in making lithographic printing plates, a colorless resin layer may be substituted in the absence of chromatic pigments. If it is to be used in making electronic circuits, the transfer recording layer may be formed of metals. In whichever type, a solution of the aforementioned sticky material has to be applied to the transfer recording layer so that it acquires a transfer initiating characteristic. Pigments are classified in two types, organic and inorganic, and either type of pigments can be used in the transfer recording layer.

If the image forming method in the embodiment under consideration is to be used to make a color proof before presswork, pigments that agree with black (K), cyan (C), magenta (M) and yellow (Y) which are commonly used in printing inks or with pigments of special colors or those which are close in tone to printing inks are employed.

Specific examples for pigments include azo-base pigments, phthalocyanine-base pigments, anthraquinone-base pigments, dioxazine-base pigments, quinacridone-base pigments, isoindolinone-base pigments, nitro-base pigments, metal powders, fluorescent pigments and inorganic mineral-base pigments. The use of these pigments contributes to improving lightfastness and waterfastness, thereby producing a non-bleeding image.

Binder Resin

An amorphous organic high-molecular weight polymer having a softening point of 40–150° C. is preferably used as the binder resin in the transfer recording layer. Specific examples include butyral resin, polyamide resin, polyethyleneimine resin, sulfonamide resin, polyester polyol resin, petroleum resin, homopolymers and copolymers of styrene, its derivatives and substituted forms such as styrene, vinyltoluene, a-methylstyrene, 2-methylstyrene, chlorostyrene, vinylbenzoic acid, vinylbenzenesulfonic acid sodium salt and aminostyrene, as well as copolymers with vinyl monomers such as acrylate esters, methacrylate esters, vinyl chloride and vinyl acetate, and other monomers. The binder resin may optionally be used in combination with plasticizers, surfactants and viscosity modifiers.

To provide the transfer recording layer, pigments, the aforementioned binder resin and any other necessary ingredients are dissolved or dispersed in a solvent to prepare a paint which is applied to the base (preferably to the undercoat on the base) and subsequently dried. Examples of the solvent include n-propyl alcohol, methyl ethyl ketone and methanol. The transfer recording layer ranges from about 0.1 to about 1.5 μm in dry thickness.

Receptor

Various materials can be used as the receptor in the embodiment under consideration and they include coated paper such as coated art paper, light coated paper and matte coated paper, non-coated paper such as woodfree paper and virtually woodfree paper, polyethylene terephthalate films, metal sheets, metal foil or film, and glass epoxy sheets, as well as dedicated image-receiving sheets.

Examples for dedicated image-receiving sheets are described below. The dedicated image-receiving sheet comprises a base having at least one image-receiving layer thereon, with one or more layers optionally provided between the base and the imagereceiving layer as selected from among a cushion layer, a release layer and an intermediate layer. The use of the dedicated image-receiving sheet contributes to increasing the adhesion strength of the transfer side of the transfer medium. The base of the dedicated image-receiving sheet may be conventional base sheetings such as a plastic sheet, a metal sheet, a glass sheet and paper. The base preferably has micropores since they contribute to preventing curls, thereby improving image quality. To prepare the base, a molten mixture of a thermoplastic resin and a loading material made of a high-molecular weight compound immiscible with inorganic pigments and the thermoplastic resin is melt extruded into a single- or multi-layered film, which is subsequently oriented either uni- or biaxially. The thermoplastic resin is preferably based on a polyolefinic resin such as polypropylene and a polyethylene terephthalate resin, with small amounts of other thermoplastic resins being optionally contained.

The preferred thickness of the base of the image-receiving sheet typically ranges from 10 to 400 μm. In order to enhance the adhesion to the image-receiving layer (or cushion layer if this is provided) or adhesion to the image-forming layer in a thermal transfer sheet, the surface of the base may be subjected to a suitable surface treatment such as corona discharge or glow discharge.

The surface of the image-receiving sheet has preferably at least one image-receiving layer on the base in order to have the image-forming layer transferred and fix it in position. The image-receiving layer is preferably formed as a layer mainly composed of an organic polymer binder. The binder is preferably a thermoplastic resin, as exemplified by homopolymers and copolymers of acrylic monomers such as acrylic acid, methacrylic acid, acrylate esters and methacrylate esters, homopolymers and copolymers of vinyl monomers such as methyl cellulose, ethyl cellulose, polyvinyl pyrrolidone, polyvinyl butyral, polyvinyl alcohol and polyvinyl chloride, condensation polymers such as polyesters and polyamides, and rubber-base polymers such as butadiene-styrene copolymer.

In order to provide an appropriate force of bonding to the image-forming layer, the binder in the image-receiving layer is preferably a polymer having a glass transition point (Tg) lower than 90° C. To this end, a plasticizer may also be added to the image-receiving layer.

The image thus formed on the image-receiving layer by the image forming method of the invention can be further transferred a printing sheet or the like. The thickness of the image-receiving layer can be adjusted to a desired value such as between 0.3 and 7 μm. As described above, the image forming method of the invention is implemented using the image transfer material, coated paper or non-coated paper or the above-described dedicated image-receiving sheet, and the solution that lowers the transfer temperature or the sticky solution.

We now describe the image forming apparatus of the invention with reference to the accompanying drawings. At the same time, we describe below the image forming method as it is implemented in three embodiments.

FIG. 1 is a schematic representation of the image forming apparatus of the invention according to its first to third embodiments.

The image forming apparatus generally indicated by 100 has a support drum 3 rotatably supported on a shaft and a transfer medium (toner sheet) 9 comprising a base 5 overlaid with a transfer recording layer 7 made of a transfer material is supported on the drum 3 as it is partly wrapped around the circumference of the drum.

The transfer material to be formed on the base 5 may be selected from among pigments, metals, resins and other suitable materials. The following description of the first embodiment of the invention is directed to the use of a pigment-base toner as the transfer material.

The toner sheet 9 is supported on the drum 3 such that the base 5 contacts a thermal drying roller 11 and the drum 3 whereas the transfer recording layer 7 faces the opposite direction.

The image forming apparatus 100 also has a pinch roller 13 in a face-to-face relationship with the support drum 3; the pinch roller 13 is supported on a shaft that extends in the same direction as the shaft on which the drum 3 is supported. Both the thermal drying roller 11 and the pinch roller 13 have built-in heaters. The support drum 3 may also have a built-in heater to provide a more uniform heat profile. The support drum 3 and the pinch roller 13 combine together to make up a pair of pressure rollers.

A receptor (image-receiving sheet) 15 onto which the transfer recording layer 7 is to be transferred is fed together with the toner sheet 9 into the gap between the support drum 3 and the pinch roller 13 as the two sheets are placed in superposition. As the support drum 3 and the pinch roller 13 rotate, the toner sheet 9 and the image-receiving sheet 15 that have been fed into the gap between the support drum 3 and the pinch roller 13 will move to the right as they are heated in a mutually contacting mode.

Woodfree paper, coated paper, a PET film or the like may be directly used as the receptor; alternatively, the dedicated image-receiving sheet may be used as the receptor. The base of the dedicated image receiving sheet may be made of paper, a PET film, a glass epoxy sheet, a metal sheet or any other suitable material.

Another component of the image forming apparatus 100 is a drop firing head 17 that is provided upstream of the support drum 3 in the direction of transport and in a face-to-face relationship with the transfer recording layer 7 in the toner sheet 9. The drop firing head 17 is adapted to be movable across the width of the toner sheet 9 by means of a head moving mechanism (not shown).

In order to transfer the transfer recording layer 7 in the toner sheet 9, the drop firing head 17 fires image-wise the solution that lowers the transfer temperature or the sticky temperature, thereby forming a latent image on the transfer recording layer 7 in the toner sheet 9 as it is supported on the drum 3. The drop firing head 17 may be of the same construction as the well-known ink head of the type described in connection with the ink-jet printer.

As soon as a latent image has been formed on the transfer recording layer by application from the head 17 of the solution that lowers the transfer temperature or the sticky solution, the solvent remains in the latent image. If most of the solvent remains in the latent image while the transfer recording layer in intimate contact with the image-receiving surface of the image-receiving sheet is passed between the pinch roller 13 and the support drum 3 under pressure, the image forming dots may occasionally spread to lower the resolution. In order to avoid this problem, the back side of the transfer recording layer 7 (its base side) is placed into contact with the temperature-controlled thermal drying roller (thermal drying means) 11 so that the amount of the solvent in the latent image is effectively controlled to ensure that the dots of the transferred image will not spread unduly.

If this control is to be done, the temperature of the thermal drying roller 11 is preferably set to be not lower than room temperature but not above the temperature at which the transfer recording layer should be transferred. It is also preferred that the temperature of the thermal drying roller 11 be appropriately adjustable in view of the transferred image by manipulating a heating temperature control unit 12 to create a satisfactory transfer.

Speaking of the condition for heating with the pinch roller 13, the temperature at the contact between the latent image forming areas of the transfer recording layer 7 and the image-receiving sheet 15 should be set to be lower than the temperature at which the transfer recording layer 7 should be transferred but not lower than the temperature at which the latent image is transferred. If this condition is met, image transfer can be accomplished with clear ON/OFF switching between the latent image forming areas of the transfer recording layer 7 and the areas where no latent image has been formed (i.e., where the solution that lowers the transfer temperature or the sticky solution has not been deposited).

The toner sheet 9 on which the latent image was formed by means of the drop firing head 17 and which has been transferred in close superposition on the image-receiving sheet 15 under heating by passage between the support drum 3 and the pinch roller 13 now passes under a stripping bar 19 so that it is stripped from the image-receiving sheet 15. As a result, the latent image forming areas of the transfer recording layer 7 are transferred onto the image-receiving sheet 15, whereupon the toner particles adhere image-wise to the image-receiving sheet 15 to render the latent image visible.

When forming a multi-color image with the image forming apparatus 100, colors such as K, C, M and Y are used as colorants to be contained in the transfer recording layer 7 in the toner sheet 9 and the transfer recording layers 7 of the respective colors are transferred image-wise onto the image-receiving sheet 15 in a given order, say, KCMY. This completes the process of forming a multicolor image on the image-receiving sheet 15.

Image formation with the image forming apparatus 100 which fires droplets of the solution that lowers the transfer temperature or the sticky solution offers the advantage that images of uniform quality can be formed that are free from the problem of uneven heat conduction that occurred in the conventional thermal transfer system due to unevenness in the resistance of the thermal head, unevenness in contact and unevenness in the thickness of the base, with the added advantage that such uniform images can be formed inexpensively without using a costly laser head. As a further advantage, the use of pigment-base toners as the constituent material of the transfer recording layer 7 eliminates the need to select special pigments and dyes that has existed in the inks for use on the ink-jet printer on account of the limitations on physical properties; hence, a suitable toner can be selected from a wide range of pigment-base toners. As a result, the desired colors can be obtained, making the image forming method of the invention suitable for use in the production of color proofs and other printed pieces that see color reproduction as one of the most important features.

The transferred image formed of droplets of the solution containing the sticky material has a particular advantage in that even if it is to be used on proofs prior to presswork, it can be directly transferred onto a printing sheet without being first transferred onto a dedicated image-receiving sheet and this contributes to simplifying the image forming process and improving the quality of the image being formed.

Yet another advantage of the invention is apparent when a multi-color transferred image is to be formed and this is solution of the problem of sensitization with a secondary color (or higher-order colors) by previously transferred images.

Figure 2:
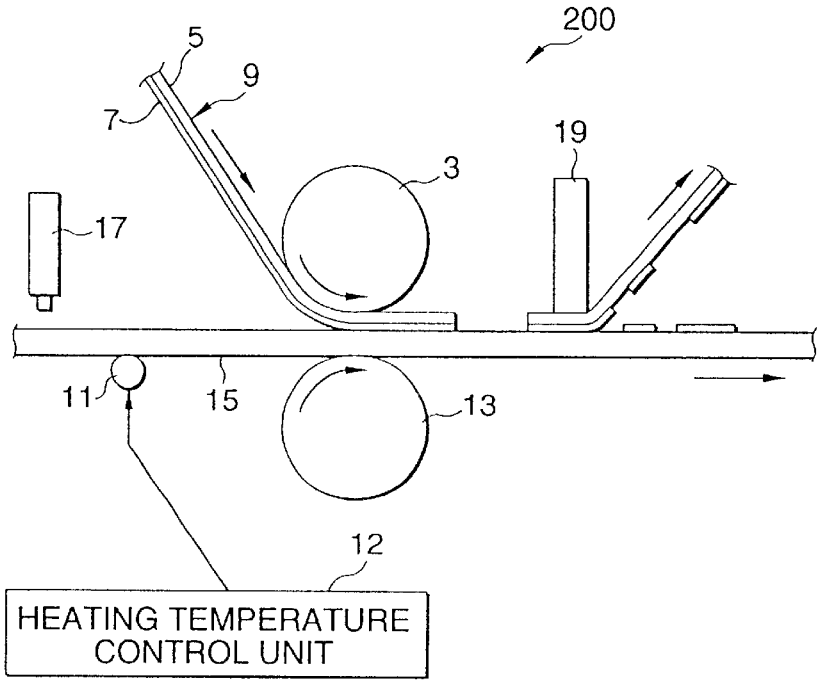
FIG. 2 is a schematic representation of the image forming apparatus of the invention according to its fourth embodiment.

We now describe the second embodiment of the image forming apparatus of the invention. FIG. 2 is a schematic representation of the image forming apparatus according to the fourth embodiment of the invention. In the image forming apparatus 100 according to the first embodiment, the drop firing head 17 fires droplets against the transfer recording layer 7 in the transfer medium (toner sheet) 9. This is not the case with the image forming apparatus according to the second embodiment which is generally indicated by 200 and the drop firing head 17 is adapted to fire droplets against the receptor (image-receiving sheet) 15. The thermal drying roller 11 is provided between the head 17 and the support drum 3. The second embodiment is the same as the first embodiment in other structural features and those parts having identical functions are designated by identical numbers and will not be described in detail.

From the head 17, droplets of the solution that lowers the transfer temperature or the sticky solution are fired image-wise against the image-receiving sheet 15 to form a latent image on it. Thereafter, part or all of the solvent in the latent image is evaporated by heating with the drying roller 11. Subsequently, the toner sheet 9 in superposition on the image-receiving sheet 15 is passed between the support drum 3 and the pinch roller 13 so that the transfer recording layer 7 in areas corresponding to the late image forming areas of the image-receiving sheet 15 is transferred onto the latter, from which toner sheet 9 is subsequently stripped, whereupon the latent image is rendered visible on the image-receiving sheet 15.

In the second embodiment of the invention, droplets of the solution that lowers the transfer temperature or the sticky solution are fired against the image-receiving sheet 15 and this offers the advantage that a thin transfer medium can be used without suffering from the problem of reduced positional precision of the latent image due to factors involved in the firing of droplets. Thus, the latent image formed by firing of the solution that lowers the transfer temperature or the sticky solution can bring about the same result whether it is formed on the transfer recording layer 7 in the toner sheet 9 or the image-receiving sheet 15.

Figure 3:
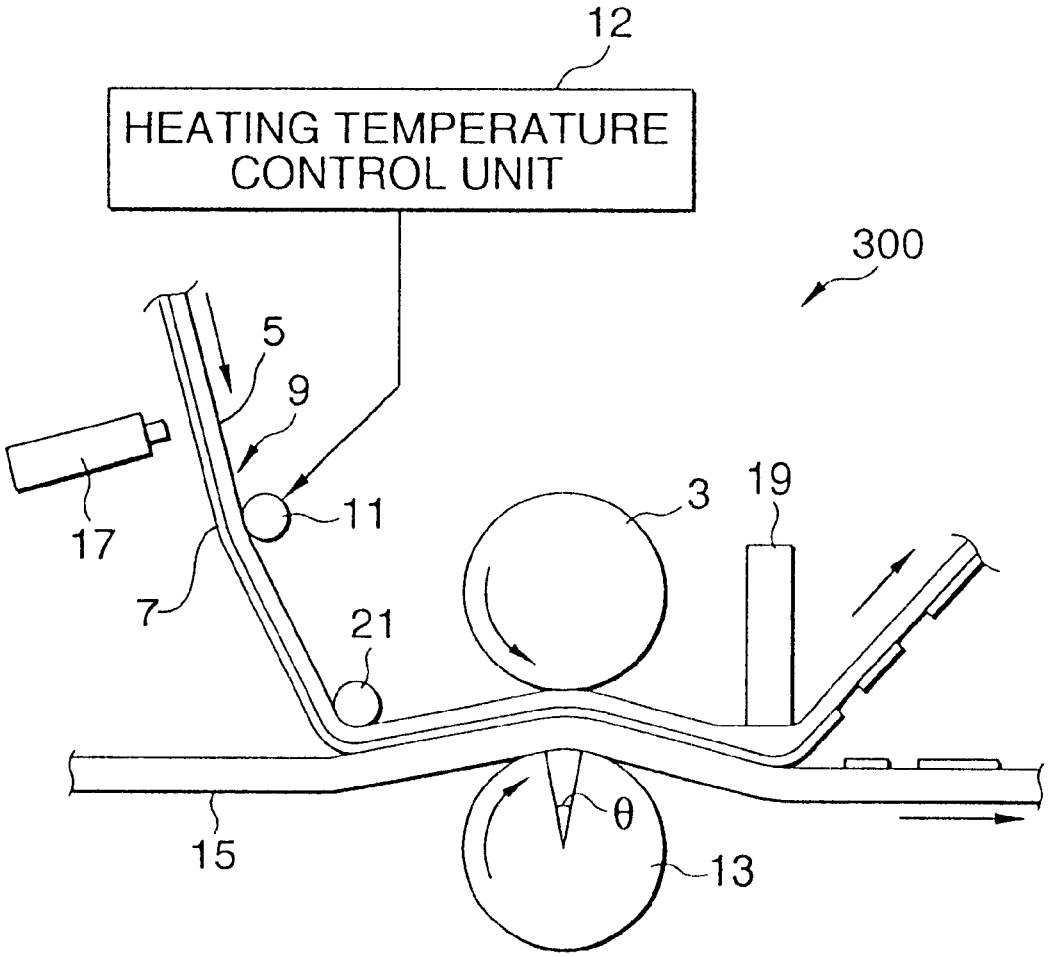
FIG. 3 is a schematic representation of the image forming apparatus of the invention according to its fifth embodiment.

We next describe the third embodiment of the image forming apparatus of the invention. FIG. 3 is a schematic representation of the image forming apparatus according to the fifth embodiment of the invention. In the image forming apparatus generally indicated by 300, a compression roller 21 is provided between the support drum 3 and the thermal drying roller 11 and activated together with the stripping bar 19 so that the assembly of the transfer medium (toner sheet) 9 and the receptor (image-receiving sheet) 15 passing between the support drum 3 and the pinch roller 13 are pressed downward in FIG. 3 to have a wrap angle 0 of about 5 degrees on the pinch roller 13.

This design sufficiently increases the wrap angle on the pinch roller 13 that the toner sheet 9 and the image-receiving sheet 15 can be transported stably without slips and other troubles. As a result, there will be no uneven feed and positional precision which is important to multi-color recording can be improved. A particular advantage is that a relatively thin sheet can be used as the receptor without causing wrinkles.

The following embodiments are provided to show the results of image formation using a transfer medium prepared by the image forming method of the invention. In the examples, all "parts" are on a weight basis.

First Embodiment (Preparation of a Transfer Medium)

Preparation of a Mother Liquor

| | |
|---|---|
| Butyral resin (Glass transition point Tg: 70° C.) | 12.0 parts |
| Magenta pigment (LIONOL RED LX-235, produced by TOYO INK MFG. CO., LTD.) | 12.0 parts |
| n-Propyl alcohol | 110 parts |
| Dispersion aid (SOLPARSE S-20000, produced by ICI Company Limited) | 0.8 parts |

To 10 parts of a dispersion obtained by fully processing the foregoing mother liquor with a disperser were added 0.24 parts of stearic acid amide and 60 parts of n-propyl alcohol to make a dilute solution which was then applied to a 5$\mu$m thick polyester film to a dry thickness of 0.38 $\mu$m. The polyester film had been treated on the back surface thereof so that it was provided with release properties.

(Preparation of Solution 1 containing a Sticky Material)

| | |
|---|---|
| Polymethyl methacrylate resin (Tg: 55° C.) | 12 parts |
| Methyl ethyl ketone | 300 parts |
| Acetone | 300 parts |

A coated art paper (128 g/m$^2$) as an image-receiving material 15 was passed between the support drum 3 and the pinch roller 13 in an image forming apparatus 100 shown in FIG. 1 while being superposed on the foregoing transfer medium with the transfer material side of the transfer medium facing downward as shown in the figure.

During this procedure, from the droplet injection head 17, droplets of the foregoing solution containing a sticky material were sprayed image-wise onto the transfer medium 9 to form a latent image. The assembly of the transfer medium 9 and the imagereceiving material 15 was then passed between the pinch roller 13 and the support drum 3, both set at 70° C., under pressure. The transfer medium 9 was then stripped from the image-receiving material 13. In this manner, a transferred recording layer 7 was transferred onto the image-receiving material 15 in correspondence to the latent image forming areas of the transfer medium. The image thus obtained had high resolution, was uniform and free of unevenness in color, and the image-receiving material had no wrinkles or other deformations.

Second Embodiment (Making a Transfer Medium)

Preparing a Mother Liquor

| | |
|---|---|
| Butyral resin (ESLEC FPD-1 of Sekisui Chemical Co., Ltd.; glass transition point, Tg: 70° C.) | 12.0 parts |
| Magenta dye (LIONOL RED X-235 of TOYO INK MFG. CO., LTD.) | 12.0 parts |
| n-Propyl alcohol | 110 parts |
| Dispersion aid (SOLPARSE S-20000 OF ICI Company Limited) | 0.8 parts |

The mother liquor was fully processed with a disperser. To 10 parts of the resulting dispersion, 0.24 parts of stearic acid amide and 60 parts of n-propyl alcohol were added to make a dilute solution, which was applied to a 5-$\mu$m thick polyester film in a dry thickness of 0.38 $\mu$m. The polyester film had been lined with a release agent.

(Making a Receptor)

First Layer Coating Paint:

| | |
|---|---|
| Vinyl chloride-vinyl acetate copolymer (SOLBAIN CL2 of Nisshin Chemical Industry Co., Ltd.) | 160 parts |
| Ethylene-vinyl acetate copolymer (ELVALOY 742 of Mitsui-Du Pont Chemical Co., Ltd.) | 61 parts |
| Poly(sebacic acid ester) (FN-G25 of Nippon Soda Co., Ltd.) | 28 parts |
| Perfluoroalkyl group containing oligomer (MEGAFAC F-178K of DAINIPPON INK AND CHEMICALS, INC.) | 4 parts |
| Methyl ethyl ketone | 630 parts |
| Toluene | 210 parts |
| Dimethyl formamide | 30 parts |

Second Layer Coating Paint:

| | |
|---|---|
| Polyvinyl butyral resin (DENKA BUTYRAL #2000-L of DENKI KAGAKU KOGYO K.K.) | 16 parts |
| N,N-Dimethylacrylamide-butyl acrylate copolymer | 4 parts |
| Perfluoroalkyl group containing oligomer (MEGAFAC F-177 of DAINIPPON INK AND CHEMICALS, INC.) | 0.5 parts |
| n-Propyl alcohol | 200 parts |

The first layer coating paint was whirl coated on a 130-$\mu$m thick PET film and the thickness of the applied coating was adjusted to 20 $\mu$m on a dry basis at 100° C. The second layer coating paint was then whirl coated on the first layer and dried at 100° C. to give the second coating in a thickness of 2 $\mu$m. This completed the process of making the receptor.

(Making Solution 1 which Lowers the Transfer Temperature)

| | |
|---|---|
| Distilled water | 80 parts |
| Ethanol | 20 parts |
| Polyoxyethylene(4)lauryl ether | 2 parts |

Third Embodiment

A transferred image was created by repeating the procedure of Example 1 except in the following points: an image forming apparatus of the type shown in FIG. 1 was used; the thermal drying roller and the pinch roller were set to temperatures of 75° C. and 65° C., respectively; the solution 1 was replaced by a solution containing the sticky material mentioned below; and coated art paper (basis weight: 128 g/m$^2$) was used as the receptor.

| | |
|---|---|
| Distilled water | 65 parts |
| Ethylene-vinyl acetate copolymer latex (solids content = 50%) | 35 parts |

The transferred image had high resolution and was uniform and free from unevenness in color; in addition, the image-receiving sheet had no wrinkles.

Fourth Embodiment

The transfer medium was superposed on the receptor and the assembly was passed between the support drum 3 and the pinch roller 13 in an image forming apparatus of the type shown in FIG. 2, with the transfer material side of the transfer medium facing down and the image-receiving side of the receptor facing up. From the firing head 17, drops of the solution 1 were propelled image-wise against the image-receiving surface of the receptor to form a latent image.

The assembly was then passed between a pressure roller pair consisting of the thermal drying roller and the pinch roller, both set at 80° C., and thereafter the transfer medium was stripped from the receptor, producing a transferred image in those areas of the image-receiving surface which corresponded to the latent image forming areas of the receptor. The transferred image had high resolution, was uniform and free of unevenness in color; the image-receiving sheet had no wrinkles or other deformations.

Fifth Embodiment

The procedure of Example 1 was followed except that the magenta pigment was replaced by phthalocyanine blue as a cyan pigment in the same amount as the magenta pigment. Thus, a cyan transfer sheet was obtained.

The transfer procedure of Example 1 was then followed except that an image forming apparatus shown in FIG. 3 was used, the pinch roller was set to a temperature of 65° C. and the solution 1 was replaced by a solution containing the sticky material mentioned below. Thus, a magenta transferred image was obtained.

(Preparation of Solution 2 Containing a Sticky Material)

| | |
|---|---|
| Distilled water | 65 parts |
| Ethylene-vinyl acetate copolymer latex (solid content: 50%) | 35 parts |

Subsequently, the procedure of Example 1 was followed except that the transfer medium was replaced by the foregoing cyan transfer sheet. Thus, a cyan transferred image was formed on the image-receiving material on which magenta had been transferred. The image thus formed had high resolution, was uniform and free from unevenness in color and secondary color sensitization. No misregistration of various colors was observed.

As described on the foregoing pages, the image forming method of the invention comprises the following steps: a solution that lowers the transfer temperature of the transfer recording layer a transfer medium or a sticky solution is applied image-wise to the surface of either the transfer recording layer or a receptor so as to form a latent image; then, at least a portion of the solvent contained in the formed latent image is evaporated by heating; finally, the transfer medium and the receptor are heated, with the surface of the transfer recording layer in intimate contact with that of the receptor, so that the transfer recording layer in areas corresponding to the ones where the latent image has been formed is selectively transferred onto the receptor. As a result, the already formed latent image is directly rendered visible on the receptor at high resolution. This eventually simplifies the image forming process and enables the formation of even images at low cost.

Being free from the problem of uneven temperature profiles of the transfer medium and the base which often occur in the conventional thermal transfer technology, the image forming method of the invention can consistently form uniform images. The method is also free from the problems of limited choice of image forming materials and the clogging of nozzles that are frequent in the conventional ink-jet technology. As a result, the latitude in the choice of image forming materials is so much increased that highquality images can be formed using various kinds of pigments that produce lightfast and waterfast colors. A particularly great advantage is obtained if the method is applied to the making of printing proofs; that is, the use of pigments commonly employed in printing inks enables the production of colors very close to those of the desired print.

The image forming apparatus of the invention has the following characteristics: by means of the drop firing head, the solution that lowers the transfer temperature of the transfer recording layer or the sticky solution is applied image-wise to the surface of either the transfer recording layer or the receptor so as to form a latent image; the thermal drying means evaporates at least a portion of the solvent in the formed latent image by heating either the transfer medium or the receptor or both on which the latent image has been formed; and by means of the pair of pressure rollers at least one of which has a heating means capable of controlling the heating temperature, the transfer medium and the receptor are heated, with the surface of the transfer recording layer in intimate contact with that of the receptor, so that only the transfer recording layer in areas corresponding to the ones where the latent image has been formed is transferred onto the receptor. As a result, the latent image formed on the receptor is directly rendered visible on the receptor at high resolution without using a costly laser head. This eventually simplifies the image forming process and enables the formation of even images at low cost.

What is claimed is:

1. An image forming method which uses a transfer medium having a transfer recording layer on a base and a receptor onto which said transfer recording layer is to be transferred, said method comprising:

a latent image forming step in which a solution for transferring said transfer recording layer onto the surface of said receptor is applied image-wise to the surface of either said transfer recording layer or said receptor so as to form a latent image;

a thermal drying step in which at least a portion of the solvent contained in the formed latent image is evaporated by heating; and a transfer step in which said transfer medium and said receptor are heated, with the surface of the transfer recording layer in intimate contact with that of the receptor, so that said transfer recording layer in areas corresponding to the ones where said latent image has been formed is transferred onto the receptor.

2. The image forming method according to claim 1, wherein said receptor is any one printing sheet selected from among paper stock, a film and a metal foil on which printing is to be done.

3. The image forming method according to claim 1, wherein the transfer recording layer in said transfer medium contains at least a pigment for use in printing inks.

4. The image forming method according to claim 1, wherein the surface to which the solution is applied image-wise to form the latent image is the transfer side of the transfer medium.

5. The image forming method according to claim 1, wherein said solution is a sticky solution.

6. An image forming apparatus which performs image-wise transfer onto a receptor of a transfer recording layer in a transfer medium which is provided on a base and which is made of a thermal transfer material, said apparatus comprising:

a drop firing head from which a solution for transferring said transfer recording layer onto the surface of said receptor is applied image-wise to the surface of either said transfer recording layer or said receptor so as to form a latent image;

a thermal drying means which heats either said transfer medium or said receptor or both on which said latent image has been formed so as to evaporate at least a portion of the solvent contained in the formed latent image; and a pair of pressure rollers which hold said transfer medium and said receptor together, with the surface of the transfer recording layer in intimate contact with that of the receptor, at least one of said pressure rollers having a heating means capable of controlling the heating temperature.

7. The image forming apparatus according to claim 6, wherein said thermal drying means has a heating temperature control unit for setting the heating temperature in accordance with the result of transfer of the transfer recording layer.

8. The image forming apparatus according to claim 6, wherein said solution is a sticky solution.

9. An image forming apparatus which performs image-wise transfer onto a receptor of a transfer recording layer in a transfer medium which is provided on a base and which is made of a thermal transfer material, said apparatus comprising:

a drop firing head from which a solution for transferring said transfer recording layer onto the surface of said receptor is applied image-wise to the surface of either said transfer recording layer or said receptor so as to form a latent image;

a thermal drying device which heats either said transfer medium or said receptor or both on which said latent image has been formed so as to evaporate at least a portion of the solvent contained in the formed latent image; and a pair of pressure rollers which hold said transfer medium and said receptor together, with the surface of the transfer recording layer in intimate contact with that of the receptor, at least one of said pressure rollers having a heating means capable of controlling the heating temperature.

* * * * *